US006169361B1

(12) United States Patent
Boffito et al.

(10) Patent No.: US 6,169,361 B1
(45) Date of Patent: Jan. 2, 2001

(54) OXYGEN DISPENSER FOR HIGH PRESSURE DISCHARGE LAMPS

(75) Inventors: Claudio Boffito, Rho; Bennie Josephus De Maagt, Eindhoven, both of (IT)

(73) Assignees: U.S. Philips Corporation, New York, NY (US); S.A.E.S. Getters S.p.A., Lainate (IT)

( * ) Notice: Under 35 U.S.C. 154(b), the term of this patent shall be extended for 0 days.

(21) Appl. No.: 09/091,812

(22) PCT Filed: Nov. 20, 1997

(86) PCT No.: PCT/IT97/00288

§ 371 Date: Jun. 23, 1998

§ 102(e) Date: Jun. 23, 1998

(87) PCT Pub. No.: WO98/22975

PCT Pub. Date: May 28, 1998

(30) Foreign Application Priority Data

Nov. 22, 1996 (IT) ..... MI96A2449

(51) Int. Cl.[7] ..... H01J 17/26

(52) U.S. Cl. ..... 313/564; 313/553; 313/562; 313/563

(58) Field of Search ..... 313/637, 25, 545–53, 313/561, 562, 563, 564, 654

(56) References Cited

U.S. PATENT DOCUMENTS 4,499,396 2/1985 Fohl et al. .
4,918,352 4/1990 Hess et al. .
5,986,405 * 11/1999 Maagt et al. ..... 313/637

* cited by examiner

*Primary Examiner*—Vip Patel
(74) *Attorney, Agent, or Firm*—Akin, Gump, Strauss, Hauer & Feld, L.L.P.

(57) ABSTRACT

It is described an oxygen dispenser for use in high pressure discharge lamps. The oxygen dispenser of the invention comprises a metallic container capable of retaining solid materials but allowing an easy passage of gas, containing silver oxide. Several possible types of dispenser are proposed. The dispenser has shown capable of avoiding the formation of black deposits coming from hydrocarbons inside the lamps.

11 Claims, 3 Drawing Sheets

OXYGEN DISPENSER FOR HIGH PRESSURE DISCHARGE LAMPS

Figure 1:
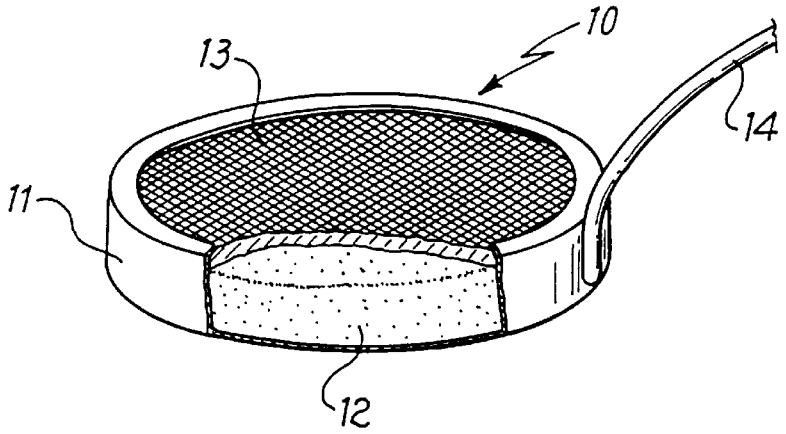

The present invention refers to an oxygen dispenser for high pressure discharge lamps. High pressure discharge lamps have a structure that comprises an outer glass envelope that may be kept evacuated or filled with an inert gas, generally nitrogen; inside the envelope is present a transparent discharge tube, that may be made of quartz or translucid ceramic, generally alumina. The outer envelope protects the discharge tube from inward diffusion of atmospheric gases that would occur in case of a non-protected tube, given the high temperatures reached by its surface during lamp working.

Discharge tube filling gases vary depending on the lamps, but these generally comprise at least one noble gas and, depending on the kind of lamp, little additions of sodium vapors, mercury vapors and metal halogenides (generally iodides). Two metallic electrodes are fitted into the ends of the discharge tube: when a potential difference is applied to the electrodes, a plasma is formed in the gaseous mixture filled in the discharge tube. The plasma emits radiations of wavelength in the visible and ultraviolet (UV) range. Some lamps also have on the inner surface of the outer envelope a thin layer of so-called phosphors, which function is to convert at least partially the UV radiation into visible light. Other lamps have a layer of ceramic powders, generally zirconium oxide ($ZrO_2$), deposited over the two ends of the discharge tube, that helps keeping the working temperature inside the tube.

Lamps manufacturers have found that small amounts of oxygen present into the outer envelope may be advantageous to the lamp functioning.

U.S. Pat. No. 4,918,352 describes a lamp having in the outer envelope an oxygen gas adding or an oxygen dispenser that releases such gas upon heating when the lamp is turned on. According to said patent this expedient serves to oxidize the surface of electric leads present in the envelope, so as to prevent losses of sodium from the gas filled in the discharge tube.

It is known from U.S. Pat. No. 4,499,396 the advantage of having a slightly oxidizing atmosphere, due to the presence of traces of oxygen, in the outer envelope of the lamp; such atmosphere prevents the reduction and blackening of phosphors that would result in lowering in time of the lamp brightness. Blackening of phosphors may occur due to the hydrocarbons present in the outer envelope. Hydrocarbons in the lamp may come from various sources. Hydrocarbons may be introduced into the outer envelope as contaminants of components of the lamp, such as the current leads; they may come from the oil of the vacuum pumps used to evacuate the envelope; or, they may be a residue of organic binders employed in the pastes used to lay some coverings, such as those of $ZrO_2$ over the discharge tube ends or those of phosphors on the inner surfaces of the envelope. At the working temperature of the lamp, hydrocarbons decompose giving rise to carbon that deposits on the outer envelope and/or on the discharge tube in the form of a black layer. This black layer not only affects the maintenance in time of the lamp brightness, but also the discharge tube temperature, giving rise to a change in the lamp color. As these deposits are formed already during the first hours of lamp operation, it would be desirable to prevent their formation at a stage as early as possible of the lamp life.

A filling of gaseous oxygen in the outer envelope soon after lamp production does not allow however to check the hermetic seal of the envelope with the method commonly used by lamp manufacturers, consisting in generating an electrical discharge, called "glow discharge", in the same envelope. As a consequence it would be advantageous having available an oxygen dispenser that releases this gas only after execution of the check of the hermetic seal of the envelope. Unfortunately the mentioned U.S. patents do not teach the use of any oxygen compound useful to this end.

APL Engineered Materials, Inc., Illinois, USA proposes in its technical-commercial catalogue the use in lamps of barium peroxide, $BaO_2$. $BaO_2$ is introduced in the outer envelope of the lamp in a device made up of a stainless steel container with a small porous lid. According to APL's catalogue, this device maintains a slightly oxidizing atmosphere in the envelope. The device must be placed into the lamp in a position such that it is heated from the discharge tube; as a consequence of heating, $BaO_2$ releases oxygen that reacts with hydrocarbons ($C_nH_m$) according to the following reactions:

$$BaO_2 \rightarrow BaO + \tfrac{1}{2} O_2 \quad \text{(I)}$$

$$C_nH_m + (n + \tfrac{1}{4} m)O_2 \rightarrow n\ CO_2 + (m/2)\ H_2O \quad \text{(II)}$$

The use of $BaO_2$ has however some drawbacks.

First, the use of $BaO_2$ in lamps had been initially proposed in U.S. Pat. No. 3,519,864 with the aim of sorbing hydrogen, generally present in lamps, that has the negative effect of increasing the voltage needed to initiate the discharge in the discharge tube. $BaO_2$ reacts with hydrogen according to the reaction:

$$BaO_2 + H_2 \rightarrow Ba(OH)_2 \quad \text{(III)}$$

Thus formed $Ba(OH)_2$ may, in turn, decompose according to the reaction:

$$Ba(OH)_2 \rightarrow BaO + H_2O \quad \text{(IV)}$$

that is quite undesirable.

Moreover, reactions (I), (II) and (IV) may take place simultaneously, thus making difficult an exact dosing of $BaO_2$. Such dosing is made even more complex by the fact that the rate of these reactions depends, in different ways, on the temperature. In order to overcome this problem, the commercial catalogue of the firm APL indicates that the positioning of the container of $BaO_2$ must be such that $BaO_2$ is maintained at a temperature comprised between about 250 and 325° C. This condition is however all but easy to realize, because the thermal profile inside lamps depends in a complex way on factors such the work positioning (horizontal, vertical or intermediate positioning) or on dimensions and materials making up the lamp housings.

Finally, the release of oxygen from $BaO_2$ takes place with high rate only at temperatures in excess of 500° C., and thus the maximum suggested temperature of 325° C. does not allow a fast release of oxygen at the very beginning of lamp life, as desirable.

Object of the present invention is to provide an oxygen dispenser for high pressure discharge lamps of fast oxygen release at relatively low temperatures.

This object is reached according to the present invention with an oxygen dispenser for high pressure discharge lamps comprising a metallic container capable of retaining solid materials but pervious to gas passage, inside which is filled silver oxide, $Ag_2O$.

$Ag_2O$ releases oxygen according to the reaction:

$$Ag_2O \rightarrow 2Ag + \tfrac{1}{2}O_2 \quad \text{(V)}$$

The use of $Ag_2O$ offers a series of advantages when compared to the use of $BaO_2$. First, oxygen release starts at temperatures of about 300° C. As a consequence, it is possible to complete the production cycle of the lamp, including the hermetic seal check with the glow discharge method, without oxygen release. On the other hand $Ag_2O$ shows a fast oxygen release at temperatures of about 340° C., and a very fast release at temperatures of about 400° C., as described in the following. It is thus available a relatively broad temperature field at rather low temperatures, between about 340 and 400° C., in which $Ag_2O$ is effective for oxygen emission. This allows a rather free positioning of the dispenser inside the lamp, particularly in zones where the dispenser can receive heat from the discharge tube without however interfering with light output of same. The oxygen dispenser may be placed near an end of the discharge tube or parallel to the same, for instance mounted on a current lead. The freedom of positioning of the oxygen dispenser is furthermore increased by the fact that oxygen may be released by means of an activation operation after completion of the lamp production, but before first turning on of same. Activation may be done by heating the dispenser with an external heat source, for instance by means of radio frequency, laser, or other suitable heating means.

A further advantage of an oxygen dispenser based on $Ag_2O$ is that it may be stored in the air and at room temperature for a relatively long time, for instance ten days, with no apparent negative effects on functioning of lamps in which it is subsequently employed.

Finally, metallic silver residual from reaction (V) is totally inert in the gaseous atmosphere of the lamp, contrary, for instance, to the products of reactions (III) and (IV).

Figure 2:
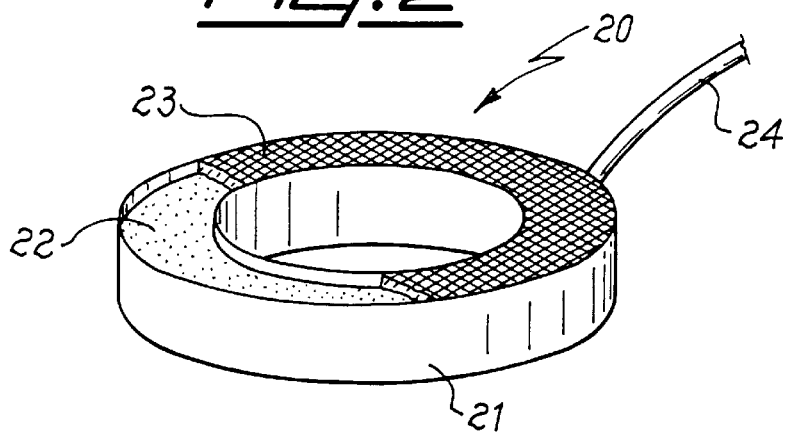
Figure 3:
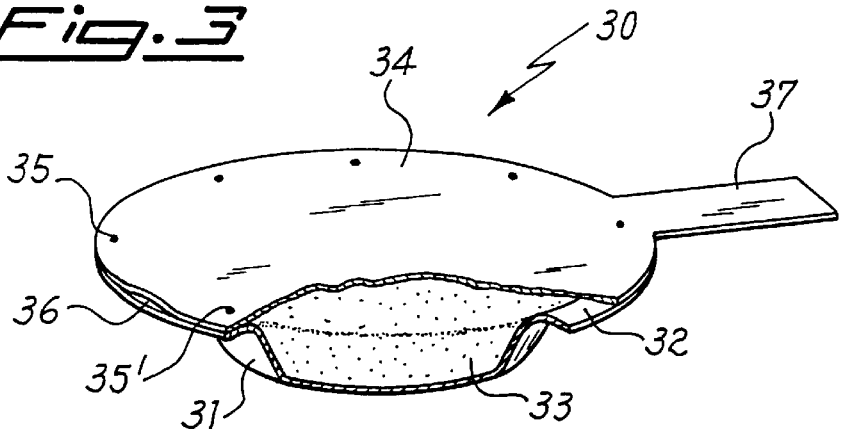
Figure 5:
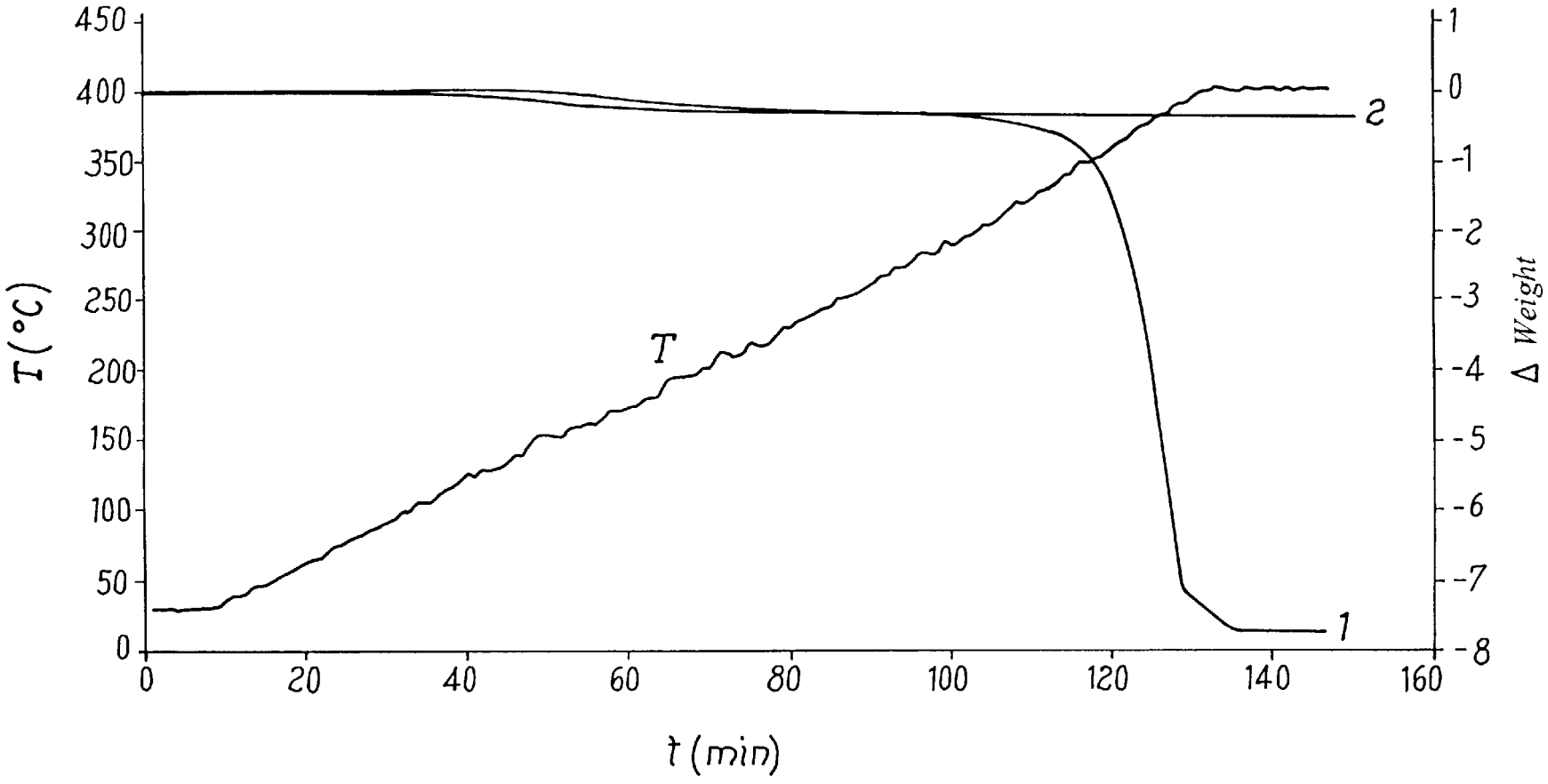

The invention will be described in detail in the following referring to the figures in which:

in FIG. 1 is shown a possible oxygen dispenser according to the invention;

in FIG. 2 is shown another possible dispenser according to the invention;

in FIG. 3 is shown still another possible dispenser according to the invention;

in FIG. 2 is shown a further dispenser according to the invention;

in FIG. 5 are reported two curves showing the oxygen release characteristics of an oxygen dispenser of the invention and of a dispenser of the prior art.

The total amount of $Ag_2O$ is not critical, and depends on the lamp dimensions, on the production process of the same and on the presence or not of $ZrO_2$ and phosphors deposits that, as described above, may be a source of hydrocarbons contamination. The necessary amount for any kind of lamp may be easily determined experimentally. $Ag_2O$ in excess of the strictly necessary amount generally does not pose problems to the lamp quality, because excess oxygen is fixed for instance by surface oxidation of current leads, as described in U.S. Pat. No. 4,918,352 cited. Generally the amount of $Ag_2O$ may be such that released oxygen is between about 0.5 and 3.3% by volume of the gaseous mixture in the envelope, when present; when no gas filling is present, the amount of $Ag_2O$ is chosen such that it gives rise to an initial oxygen pressure in the envelope comprised between about 5 and 20 mbar.

The physical form of $Ag_2O$ is immaterial as to the working of the dispenser of the invention, and it could be employed in form of extremely fine powders, with grains of dimension of the order of nanometers, up to monocrystals of dimensions in the range of millimeters. For production ease, however, $Ag_2O$ is preferably employed in the form of powder of grains dimension comprised between about 0.1 and 50 microns ($\mu$m). In the case of dispensers containing small amounts of $Ag_2O$, or in the case the oxide is employed in form of very fine powders, it is also possible to add to $Ag_2O$ powder of an inert material, for instance alumina, in order to make easier dosing and handling the powders in the production line.

The container may be made of various metals, such as stainless steel, nickel or titanium; for ease of working, preferred is the use of nickel-plated iron or nickel-chromium alloys.

When a hydrogen getter, such as $Zr_2Ni$, is present in the outer envelope of the lamp, the oxygen dispenser and the getter may be integrated. Thus, $Ag_2O$ and getter may have a common metallic support; the two materials may, for instance, be housed in a common cavity of the support, possibly also admixed. The use of a common support, and possibly of the mixture, lower the production costs of the oxygen dispenser and of the getter and the assembling costs of lamps.

The dispenser of the invention may have any geometrical shape; some examples are given in the following, in describing the figures.

A first possible form is shown in a cut-away view in FIG. 1. In this embodiment the dispenser 10 comprises a cylindrical container 11, with a closed bottom and open upwardly. Inside the container is placed $Ag_2O$ 12 that may be in form of either loose or compressed powder. The upper aperture is closed by a retention element 13, capable of retaining powders and pervious to gas passage, such as a disk of sintered metallic powders. A support 14 is fixed to the container, useful for fastening the dispenser inside the lamp.

A possible alternative shape of the dispenser of the invention is shown in a cut-away view in FIG. 2; in this case the dispenser 20 comprises a ring container 21, in the bottom of which is filled the powder 22 of $Ag_2O$, compressed or not; in this case too the powder is maintained in its place by a retention element 23 made of metallic porous material and a support 24 is fixed to the container 20.

Still another kind of device according to the invention is represented in FIG. 3; in this case the dispenser 30 is made up of a hollow container 31, obtained by simple cold forming of a metallic foil; this container has an upper edge 32 that is flat and parallel to the container bottom; in the concavity of container 31 is filled $Ag_2O$ 33; the upper part of the dispenser is closed by a retention element 34 realized in this case with a continuous metallic foil, welded to edge 32 with a non-continuous welding, such as a few welding spots 35, 35', . . .; the presence of a non-continuous welding guarantees that the container be impervious to powders allowing however the release of oxygen from thin openings 36 remaining between the edge 32 and the retention element 34 among next welding spots (only one of such openings is shown in the figure, with increased dimensions for the sake of clarity); finally, in this case too it is needed a support element in order to fix the dispenser inside the lamp; this support element may be simply obtained suitably shaping upper edge 32 and retention element 34, so that one of these present a tongue 37.

Figure 4:
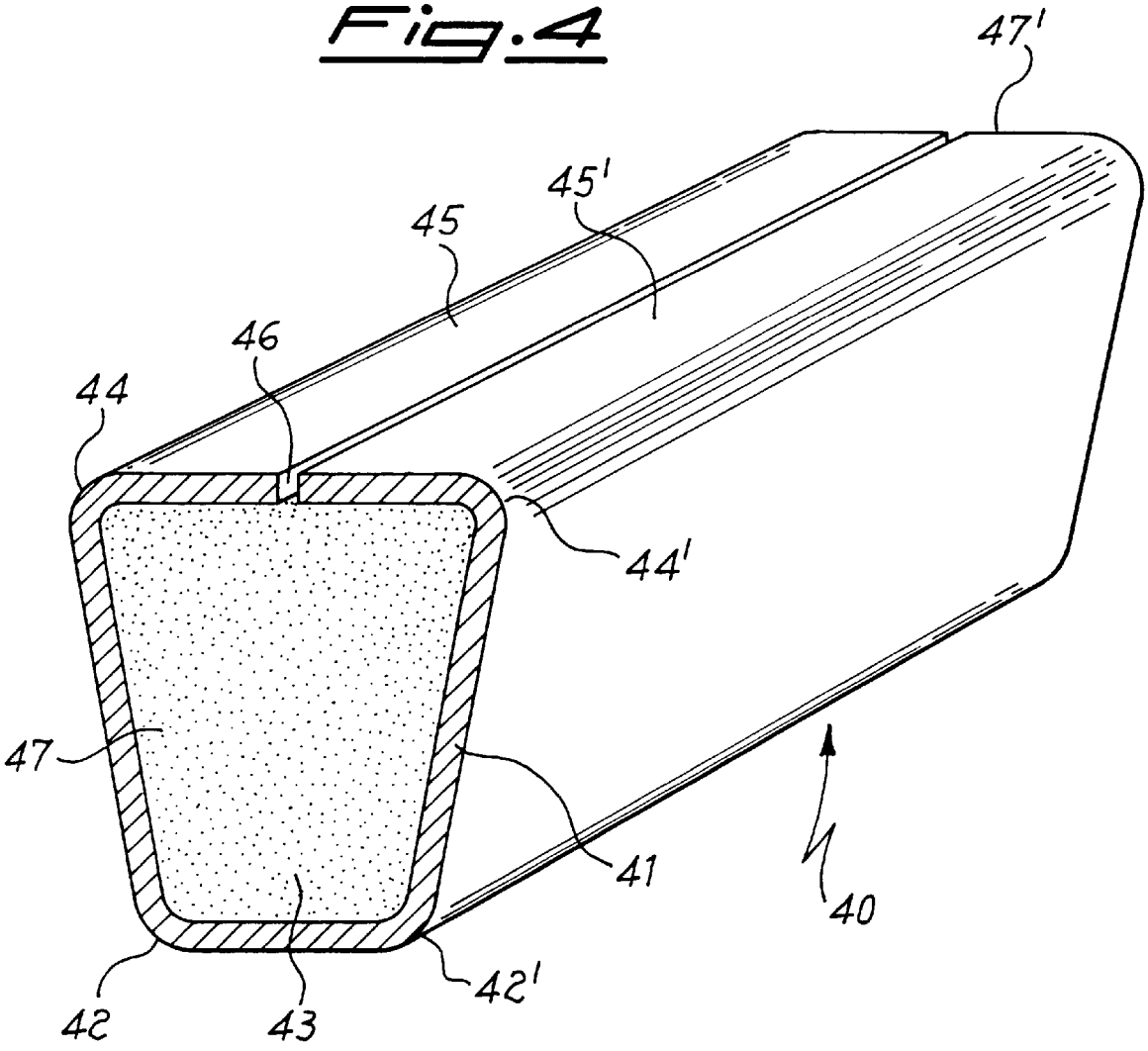

Finally, another possible embodiment of the dispenser of the invention is shown in FIG. 4. In this case the dispenser 40 has an elongated shape and comprises a container 41 obtained by cold forming of a metallic tape of suitable width; the first two bendings, localized along lines 42, 42', produce an elongated channel in which is filled the powder 43 of $Ag_2O$; the metallic tape is then further bent along lines 44,44' so as to form two surfaces 45, 45' that taken together define a face of the container. The bendings are made in such a way that between the edges of surfaces 45, 45' remains a thin slit 46, that allows an easy outlet of oxygen. This embodiment allows the continuous production of the dispenser of the invention: it is possible to produce "wires" of indefinite length that may then be cut in pieces of desired length such as the one shown in FIG. 4. The open ends 47, 47', that are formed with the cutting of the wire and from which $Ag_2O$ could escape, may be sealed with suitable means (plugs, ceramic pastes, . . . ) or closed by compression, that may be realized during the same operation of cutting of the wire.

Obviously, also other shapes of device are possible, as long as it is realized the condition of having a container that holds the powders allowing however the passage of gas.

The invention will be further illustrated by the following non-limiting examples, having the object of teaching to those skilled in the art how to practice the invention and of representing the best mode known for the realization of the invention.

EXAMPLE 1

108 mg of $Ag_2O$ are placed inside a container as shown in FIG. 1, closed with a sintered steel porous disk with an average porosity of about 1 $\mu$m. The $Ag_2O$ container is placed in the vacuum-proof measure chamber of a microbalance CAHN model 121. The chamber is evacuated down to a residual pressure of $10^{-5}$ mbar. The sample is heated from room temperature up to 400° C. with a heating rate of 3° C./min. The thermal program is controlled by a computer that records both weight changes of the sample and temperature of same measured by a thermocouple as a function of time. Released gases are analyzed by a mass spectrometer. The results of the test are reported in FIG. 5. The changes of weight as a function of time are reported as curve 1 and their values are to be read on the vertical axis on the right-hand side of the figure. The values of temperature as a function of time are reported as curve T, and are to be read on the vertical axis on the left-hand side of the graph. Curve 1 shows a little weight change around 150° C. that from mass spectrometer analysis has resulted to be due to small amounts of $CO_2$ and $H_2O$ released from the sample. Disregarding this contribution, and measuring weight changes of the sample between about 300 and 400° C., one obtains a weight loss of about 7.4 mg, corresponding to 100% of the total amount of oxygen that may be released by the sample.

EXAMPLE 2 (COMPARISON)

The test of example 1 is repeated, employing 195 mg of $BaO_2$ in place of $Ag_2O$. The results of the test are reported in FIG. 5 as curve 2. In this case too it is present a small weight change around 150° C., due to emission from the sample of $CO_2$ and $H_2O$. Apart from this weight change, the sample does not undergo measurable any weight losses up to 400° C.

EXAMPLE 3

The characteristics of some metal halogenide lamps, both with the oxygen dispenser and without such dispenser, are evaluated. Specifically, the tests are carried out on the following kinds of lamps: reference lamps (Ref. lamps) without oxygen dispenser; lamps containing oxygen dispensers kept under inert atmosphere until their introduction into the lamp (FD lamps); lamps with "aged" dispensers, exposed 72 hours to the air prior to mounting inside the lamp (AD lamps); lamps intentionally contaminated with hydrocarbons and not containing oxygen dispensers (O lamps); and lamps intentionally contaminated with hydrocarbons and containing an oxygen dispenser kept under inert atmosphere until mounting inside the lamp (OFD lamps); in the tests some lamps of any kind are used. The oxygen dispensers used in these tests contain 115 mg of $Ag_2O$. All the lamps further contain a $Zr_2Ni$-based hydrogen getter. For any lamp, the light output (given in lumen, lm) and the x coordinate of the color point in the triangular color diagram known in the field, are measured. These data are measured as soon as the lamp has reached steady operation conditions, after about 15' from the first turning on, and after 100 more hours of work. As the gas filling of the discharge tube contains sodium iodide, a rise of the discharge tube temperature due to the formation of a black deposit results in a higher amount of sodium vapors in the discharge, having as a consequence an increase of the x coordinate; so, a non-increase of the x coordinate is a sign of the fact that a black carbon deposit is not formed. The results of tests are reported in Table 1, as luminous output and x coordinate value at 0 hours of steady operation and after 100 hours of steady operation; the Table also reports the percentage of luminous output at 100 hours with respect to that at 0 hours, that gives an indication of the maintenance of the lamp brightness in time.

TABLE 1

| Lamps | Measured quantity | 0 hours | 100 hours | Lum. maintenance (%) |
|---|---|---|---|---|
| Ref. | lm | 19640 ± 270 | 17680 ± 520 | 90.0 |
| | x | 356 ± 3 | 368 ± 5 | |
| FD | lm | 20140 ± 345 | 19640 ± 380 | 97.5 |
| | x | 360 ± 4 | 355 ± 5 | |
| AD | lm | 20500 ± 455 | 19950 ± 330 | 97.3 |
| | x | 360 ± 4 | 357 ± 1.5 | |
| O | lm | 17470 ± 1140 | 12730 ± 2090 | 72.9 |
| | x | 368 ± 9 | 380 ± 8 | |
| OFD | lm | 18955 ± 970 | 19435 ± 555 | 102.5 |
| | x | 363 ± 6 | 358 ± 4 | |

By comparison of curves in FIG. 5 it is evident that release of oxygen from $Ag_2O$ starts at about 340° C. and it is complete at about 400° C., whereas upon treating at temperatures up to 400° C. $BaO_2$ does not release measurable amounts of oxygen.

Moreover, comparing in Table 1 the results of the Ref. lamps with those of FD and AD lamps it is noted that oxygen dispensers guarantee a better maintaining of the luminous output, irrespective of the fact that the dispenser is previously kept under inert atmosphere or exposed to the air. The detrimental effect of the hydrocarbons is evident from the values reported for O lamps. From the last line of Table 1 it is clear that the oxygen dispenser is capable of obviating the damaging effects of hydrocarbons (OFD lamps). The x coordinate of the color points at 100 hours, that are lower in the lamps with oxygen dispenser, confirm that the deposit of a carbon deposit is avoided.

Finally, mass spectrometer analyses of the gases present inside the outer envelope of the lamps have been carried out after 2000 hours of operation; these tests have shown that lamps with oxygen dispenser contain $CO_2$ but not hydrogen. The capability of the hydrogen getter is not impaired by the oxygen release. $CO_2$ is slowly reabsorbed by the getter, but its presence is not detrimental for lamp working.

What is claimed is:

1. Oxygen dispenser for high pressure discharge lamps comprising a metallic container capable of retaining solid materials but pervious to gas passage, inside which is filled silver oxide, $Ag_2O$.

2. Oxygen dispenser according to claim 1 in which the $Ag_2O$ is in the form of powder.

3. Oxygen dispenser according to claim 2 in which the $Ag_2O$ powder has a granulometry comprised between 0.1 and 50 $\mu$m.

4. Oxygen dispenser according to claim 1 wherein the container is a cylindrical container (11) with a closed bottom and open upwardly and the $Ag_2O$ (12) is inside the container; the oxygen dispenser further comprising:

a retention element (13) covering the $Ag_2O$ and capable of retaining powders but pervious to the passage of gas; and a support (14) fixed to the container (11).

5. Oxygen dispenser according to claim 1, wherein the container is a ring container (21), with a closed bottom and open upwardly and the $Ag_2O$ (22) is inside the container; the oxygen dispenser further comprising:

a retention element (23) covering the $Ag_2O$ and capable of retaining powders but pervious to the passage of gas; and a support (24) fixed to the container (21).

6. Oxygen dispenser according to claim 1, wherein the container is a hollow container (31), with a flat upper edge (32) and the $Ag_2O$ (33) is inside the hollow part of the container (31); the oxygen dispenser further comprising:

a retention element (34) made of a continuous metallic foil, fixed to the edge (32) by means of a non-continuous welding (35, 35', . . .);

apertures (36) between the edge (32) and the element (34) in correspondence of the discontinuities of the weld; and a support element (37).

7. Oxygen dispenser according to claim 1, wherein the container is a container (41) of polygonal section, obtained by bending a metallic tape along pairs of parallel lines (42, 42') and (44, 44'), a face of which is defined by two surfaces (45, 45') having edges and the $Ag_2O$ powder (43) is inside the container; the oxygen dispenser further comprising:

a slit (46) between the edges of the surfaces (45, 45'); and closing means of the open ends (47, 47') of the metallic container.

8. Oxygen dispenser according to claim 1 further comprising powder of an inert material.

9. Oxygen dispenser according to claim 1 further comprising a getter material.

10. Oxygen dispenser according to claim 7 in which the $Ag_2O$ and the getter material are placed in positions apart of the dispenser.

11. Oxygen dispenser according to claim 7 in which the $Ag_2O$ and the getter material are admixed.

* * * * *